US009668549B2

(12) United States Patent
Tsuzuyama

(10) Patent No.: US 9,668,549 B2
(45) Date of Patent: Jun. 6, 2017

(54) FASTENER TAPE FOR SLIDE FASTENER, AND SLIDE FASTENER

(75) Inventor: Mitsuo Tsuzuyama, Toyama (JP)

(73) Assignee: YKK Corporation (JP)

( * ) Notice: Subject to any disclaimer, the term of this patent is extended or adjusted under 35 U.S.C. 154(b) by 254 days.

(21) Appl. No.: 14/343,695

(22) PCT Filed: Sep. 9, 2011

(86) PCT No.: PCT/JP2011/070589
§ 371 (c)(1),
(2), (4) Date: Mar. 7, 2014

(87) PCT Pub. No.: WO2013/035193
PCT Pub. Date: Mar. 14, 2013

(65) Prior Publication Data

US 2014/0223699 A1 Aug. 14, 2014

(51) Int. Cl.
*A44B 19/34* (2006.01)
*D03D 1/00* (2006.01)

(52) U.S. Cl.
CPC ..... *A44B 19/346* (2013.01); *A44B 19/343* (2013.01); *D03D 1/00* (2013.01); *D10B 2501/0631* (2013.01); *Y10T 24/25* (2015.01)

(58) Field of Classification Search
CPC ..... A44B 19/346; A44B 19/343; D03D 1/00; D10B 2501/0631; Y10T 24/25
See application file for complete search history.

(56) References Cited

U.S. PATENT DOCUMENTS 1,622,250 A * 3/1927 Moore ..... A44B 19/346 139/384 B
1,715,006 A * 5/1929 Losey ..... A44B 19/346 139/384 B (Continued)

FOREIGN PATENT DOCUMENTS

AU 3666178 A 12/1979
AU 518249 B 9/1981

(Continued)

OTHER PUBLICATIONS

International Preliminary Report on Patentability, PCT Application No. PCT/JP2011/070589, Mar. 12, 2014.

(Continued)

*Primary Examiner* — Anna Kinsaul
*Assistant Examiner* — Jocelyn Wu
(74) *Attorney, Agent, or Firm* — Kilpatrick Townsend & Stockton LLP

(57) ABSTRACT

This fabric fastener tape for a slide fastener is provided with an element mounting section and a tape main body section. The tape main body section is provided with a mesh section. The mesh section has a mesh structure having a framework formed by sets of warp yarns and weft yarns, and the mesh structure has openings formed among the sets of warp yarns and weft yarns. In the mesh section, the weave density of the outermost warp yarn and the outermost weft yarn of each of the sets of warp yarns and weft yarns is higher than the weave density of the warp and weft yarns which are on the inner side of the outermost warp and weft yarns. In the mesh structure of this fastener tape, mesh displacement can be prevented without thermally bonding the crossover points between the warp and weft yarns.

14 Claims, 7 Drawing Sheets

(56) References Cited

U.S. PATENT DOCUMENTS 1,820,327 A * 8/1931 Saunders ..... A44B 19/06 24/411
2,195,895 A * 4/1940 Moore ..... A44B 19/346 139/384 B
2,380,939 A * 8/1945 Campbell ..... A44B 19/346 139/384 B
2,383,767 A * 8/1945 Brownlow ..... A44B 19/346 139/11
2,405,902 A * 8/1946 Poux ..... A44B 19/346 139/384 B
2,470,251 A * 5/1949 Messer ..... A44B 19/34 139/384 B
2,607,715 A * 8/1952 Waldes ..... A41H 37/003 139/384 B
2,718,047 A * 9/1955 Waldes ..... A44B 19/346 139/384 B
2,860,668 A * 11/1958 Hendley ..... A44B 19/346 139/384 B
2,907,355 A * 10/1959 Hendley ..... A44B 19/346 139/384 B
2,940,478 A * 6/1960 Hendley ..... A44B 19/346 139/384 B
3,068,908 A * 12/1962 Firing ..... A44B 19/346 139/384 B
3,136,343 A * 6/1964 Firing ..... A44B 19/346 139/431
3,444,598 A * 5/1969 Darandik ..... A41H 37/003 112/475.16
3,454,052 A * 7/1969 Burbank ..... A44B 19/54 139/384 B
3,524,479 A * 8/1970 Burbank ..... A44B 19/54 139/116.1
3,765,457 A * 10/1973 Glindmeyer ..... A44B 19/10 139/116.1
3,796,237 A * 3/1974 Heidermann ..... A44B 19/54 139/384 B
3,807,462 A * 4/1974 Nogai ..... A44B 19/54 139/384 B
3,822,444 A * 7/1974 Johns ..... A44B 19/12 24/391
3,921,679 A * 11/1975 Glindmeyer ..... A44B 19/54 139/384 B
3,941,163 A * 3/1976 Glindmeyer ..... A44B 19/54 139/384 B
3,961,652 A * 6/1976 Hasuda ..... A44B 19/34 139/384 B
3,991,249 A * 11/1976 Yamashita ..... B60R 21/235 139/389
4,011,895 A * 3/1977 Dal Negro ..... A44B 19/54 139/384 B
4,044,432 A * 8/1977 Ebata ..... A01K 73/12 139/384 B
4,058,144 A * 11/1977 Dal Negro ..... A44B 19/54 139/384 B
4,134,397 A * 1/1979 Gianakakos ..... A61L 15/12 602/8
4,149,571 A * 4/1979 Burroughs ..... D21F 1/0027 139/383 A
4,181,159 A 1/1980 Frohlich et al.
4,191,220 A * 3/1980 Yoshida ..... A44B 19/346 139/384 B
4,214,578 A 7/1980 Gianakakos et al.
4,231,138 A * 11/1980 Moertel ..... A44B 19/346 24/401
4,308,898 A * 1/1982 Yamaguchi ..... A44B 19/346 139/384 B
4,313,245 A * 2/1982 Yamaguchi ..... A44B 19/346 139/384 B
4,334,556 A * 6/1982 Frohlich ..... A44B 19/346 139/384 B
4,344,423 A 8/1982 Evans et al.
4,354,532 A * 10/1982 Tsubata ..... A44B 19/346 139/384 B
4,404,998 A * 9/1983 Frohlich ..... A44B 19/346 139/384 B
4,406,310 A * 9/1983 Reader ..... D05C 17/023 139/391
4,539,733 A * 9/1985 Yoshida ..... A44B 19/346 24/394
4,668,545 A * 5/1987 Lowe ..... B29C 61/0658 139/387 R
4,678,013 A * 7/1987 Ofusa ..... A44B 19/12 139/384 B
4,918,793 A * 4/1990 Spindler ..... A44B 19/406 139/384 B
5,069,952 A * 12/1991 Gruenenfelder ..... A44B 19/346 139/384 B
5,140,725 A * 8/1992 Matsushima ..... A44B 19/34 139/384 B
5,401,555 A * 3/1995 Yamakita ..... D03D 15/00 139/383 R
5,417,249 A * 5/1995 Kato ..... A44B 19/346 139/384 B
5,472,019 A * 12/1995 Shimono ..... A44B 19/406 139/384 B
5,562,967 A * 10/1996 Kikuchi ..... D03D 9/00 139/383 R
5,713,398 A * 2/1998 Josef ..... D21F 1/0027 139/383 A
6,330,892 B1 * 12/2001 Shimono ..... A44B 19/346 139/384 B
6,505,652 B1 * 1/2003 Matsushima ..... A44B 19/346 139/384 B
7,836,563 B2 * 11/2010 Horikawa ..... A44B 19/346 139/384 B
7,992,266 B2 * 8/2011 Horikawa ..... A44B 19/346 139/384 B
9,169,583 B2 * 10/2015 Hasegawa ..... A44B 19/346
2003/0110602 A1 * 6/2003 Matsuda ..... A44B 19/343 24/436
2003/0121589 A1 7/2003 Iwashita et al.
2004/0173276 A1 * 9/2004 Horikawa ..... A44B 19/346 139/384 B
2005/0066485 A1 * 3/2005 Cheng ..... A44B 19/346 24/398
2006/0016052 A1 * 1/2006 Horikawa ..... A44B 19/346 24/393
2006/0070681 A1 * 4/2006 Haroutoonian ..... D03D 1/0011 139/383 R
2013/0185903 A1 * 7/2013 Matsuzawa ..... A44B 19/346 24/415
2013/0219676 A1 * 8/2013 Takahashi ..... A44B 19/346 24/403
2015/0059915 A1 * 3/2015 Yun ..... D03D 1/0041 139/420 R

FOREIGN PATENT DOCUMENTS

| | | | |
|---|---|---|---|
| BR | 7803538 | A | 4/1979 |
| CA | 1116490 | A | 1/1982 |
| CA | 1132419 | A | 9/1982 |
| CA | 2127715 | A | 5/1994 |
| CH | 623213 | A | 5/1981 |
| CN | 1264558 | A | 8/2000 |
| CN | 1428237 | A | 7/2003 |
| DE | 2823340 | A | 12/1978 |
| DE | 2707946 | A | 1/1979 |
| EP | 624668 | A1 | 11/1994 |
| EP | 1033089 | A1 | 9/2000 |
| EP | 1323514 | A2 | 7/2003 |
| FR | 2392678 | A | 12/1978 |
| GB | 1592228 | A | 7/1981 |
| HK | 1054003 | A | 7/2006 |
| HK | 1029260 | A | 7/2008 |
| IN | 148546 | A | 3/1981 |
| IT | 1104704 | B | 10/1985 |
| JP | 53-106242 | A | 9/1978 |

(56) References Cited

FOREIGN PATENT DOCUMENTS

| | | | |
|---|---|---|---|
| JP | 54-3393 | A | 1/1979 |
| JP | 3-16853 | A | 1/1991 |
| JP | 5-42731 | Y2 | 10/1993 |
| JP | 6-158471 | A | 6/1994 |
| JP | 2000-245509 | A | 9/2000 |
| JP | 2003-189913 | A | 7/2003 |
| KR | 10-0215488 | B | 8/1999 |
| NO | 942584 | A | 9/1994 |
| SG | 106663 | A | 10/2004 |
| TW | 587983 | B | 5/2004 |
| WO | 94/11552 | A1 | 5/1994 |
| ZA | 7803142 | A | 1/1980 |

OTHER PUBLICATIONS

International Search Report, PCT Application No. PCT/JP2011/070589 mailed Dec. 13, 2011.

* cited by examiner

FASTENER TAPE FOR SLIDE FASTENER, AND SLIDE FASTENER

This application is a national stage application of PCT/JP2011/070589, which is incorporated herein by reference.

TECHNICAL FIELD

The present invention relates to a fastener tape for a slide fastener, and a slide fastener having the fastener tape.

BACKGROUND ART

Slide fasteners are often used as opening/closing tools for not just daily commodities such as clothes, bags, shoes, and sundries but also industrial products such as tents. A slide fastener is mainly composed of three units: a pair of long tapes; a number of elements serving as engagement parts of a fastener that are sewn along one side of each tape; and a slider controlling the opening and closing of the fastener by engaging or separating the elements.

As the tape for the slide fastener, a woven tape obtained by weaving the warp yarns and the we yarns is frequently employed. A basic structure of a woven tape for the slide fastener is shown in FIG. 7. This drawing is FIG. 1 disclosed in Japanese Examined Utility Model Application Publication No. H5-42731 (Patent Literature 1), and this woven tape includes an element mount section A and a tape main body section B which are composed of warp yarns 2 and weft yarns 3. The element mount section A is a portion where elements are mounted, and the tape main body section B is sewn to a body of a product. To the element mount section A, elements 1 are mounted with a mount yarn 5. Further, an end of the tape main body section B can be provided with a selvage yarn 8 for preventing the yarns from getting loose.

An object of Patent Literature 1 is to provide an inexpensive slide fastener tape that can be stably mounted to objects and that are less likely to cause the puckering or the mesh deviation even when the tape main body section is formed using a rough weave structure. In order to achieve the object, the element mount section A is formed using a structure with high weaving density, and the tape main body section B is formed using a rough, mesh-like structure in which a yarn having a multifilament yarn as a core material and having a surface coated with synthetic resin is used as at least one of the warp yarns and the weft yarns and each intersection of the yarns is welded.

CITATION LIST

Patent Literature

Patent Literature 1
Japanese Examined Utility Model Application Publication No. H5-42731

SUMMARY OF THE INVENTION

Problems to be Solved by the Invention

In the field of sports apparel, recently, the air permeability has come to be more required for preventing the stuffiness of the inside of the apparel during the wearing. The slide fastener also needs to meet the demand. It is considered that the fastener tape according to Patent Literature 1 has relatively high air permeability because the tape main body section has a rough, mesh-like structure. However, at least one of the warp yarns and the weft yarns are coated with synthetic resin and the intersection between the warp yarns and the weft yarns is welded, which results in a problem that the fastener tape becomes hard.

The present invention has been made in view of the above circumstances, and an object is to provide a fastener tape for a slide fastener, in which the mesh deviation is suppressed without welding the intersection between the warp yarn and the weft yarn while the air permeability is secured by the provision of the mesh structure. Another object of the present invention is to provide a slide fastener having the above fastener tape.

Solutions to the Problems

The present inventor has found the solution to the above problem by devising the weave structure of the tape main body section, and has created the invention specified by the following.

An aspect of the present invention is a woven fastener tape for a slide fastener, including an element mount section and a tape main body section, wherein: the tape main body section has its framework formed by sets of three or more warp yarns and three or more weft yarns, and has a mesh section having a mesh structure provided with an opening among the sets of the warp yarns and the weft yarns; the interlacing density of the outermost warp yarn and the outermost weft yarn in each set of the warp yarns and the weft yarns is higher than the interlacing density of the warp yarns and the weft yarns that are on the inner side of the outermost yarns.

In an embodiment of the fastener tape for the slide fastener according to the present invention, the area of each opening of the mesh section is 0.36 to 6 $mm^2$.

In another embodiment of the fastener tape for a slide fastener according to the present invention, in each set of the warp yarns and the weft yarns which form the framework of the mesh structure, the total thickness of the warp yarns is larger than the total thickness of the weft yarns.

In a further embodiment of the fastener tape for a slide fastener according to the present invention, each set of the warp yarns and the weft yarns, which form the framework of the mesh structure, is composed of three to five warp yarns and three to five weft yarns.

In a further embodiment of the fastener tape for a slide fastener according to the present invention, each set of the warp yarns and the weft yarns, which form the framework of the mesh structure, includes more weft yarns than the warp yarns.

In a further embodiment of the fastener tape for a slide fastener according to the present invention, the outermost warp yarn and the outermost weft yarn in each set of the warp yarns and the weft yarns is selected from the 1/1, 1/2, and 2/1 weave structures and the warp yarn and the weft yarn that are on the inner side of the outermost yarns are selected from the 3/3 and 4/4 weave structures.

In a further embodiment of the fastener tape for a slide fastener according to the present invention, the tape main body section includes a first section that is close to the element mount section and a second section that is distant from the element mount section, and the first section is the mesh section and the second section has a weave structure with higher weaving density than the mesh section.

In a further embodiment of the fastener tape for a slide fastener according to the present invention, the warp yarns of the first section are more twisted than the warp yarns of the second section.

In a further embodiment of the fastener tape for a slide fastener according to the present invention, the weft yarns are more twisted than the warp yarns of the second section.

In a further embodiment of the fastener tape for a slide fastener according to the present invention, one of or both the warp yarns and the weft yarns of the mesh section have a twisting coefficient of 2.0 T/M or more per dtex.

In a further embodiment of the fastener tape for a slide fastener according to the present invention, the opening of the mesh section has a rectangular shape that is longer in a width direction of the fastener tape than in a longitudinal direction of the fastener tape.

In a further embodiment of the fastener tape for a slide fastener according to the present invention, in each set of the warp yarns, the interlacing state between the outermost warp yarn and the outermost weft yarn is in an opposite relation to the interlacing state between the warp yarn that is on the inner side of the outermost warp yarn and the outermost weft yarn, and in each set of the weft yarns, the interlacing state between the outermost weft yarn and the outermost warp yarn is in an opposite relation to the interlacing state between the weft yarn that is on the inner side of the outermost weft yarn and the outermost warp yarn.

In a further embodiment of the fastener tape for a slide fastener according to the present invention, at one of or both an upper end and a lower end of the fastener tape, a reinforcement film is pasted across the mesh section in the width direction so that a front side and a back side of the fastener tape are coated.

Another aspect of the present invention is a slide fastener having any of the aforementioned fastener tapes for a slide fastener.

Advantageous Effects of the Invention

According to the present invention, the fastener tape for the slide fastener in which the mesh deviation is suppressed without welding the intersections between the warp yarns and the weft yarns while the air permeability is secured by the provision of the mesh structure.

DESCRIPTION OF EMBODIMENTS

<1. Fastener Tape>

Figure 1:
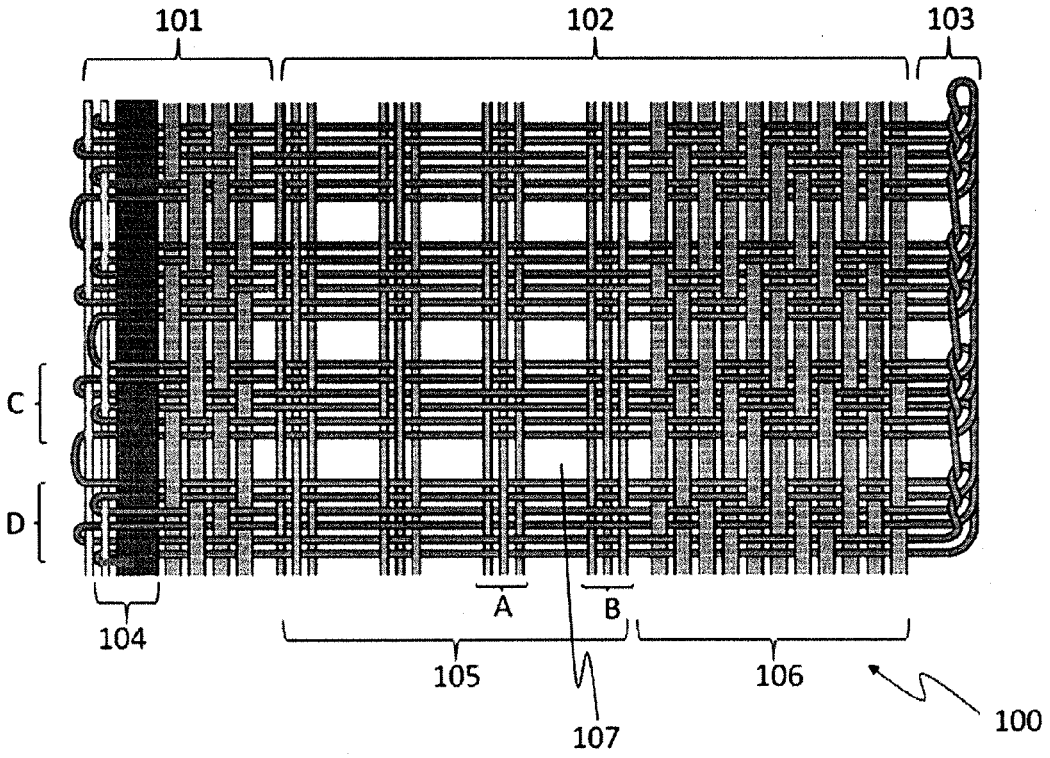
FIG. 1 depicts a weave structure of a fastener tape according to a first embodiment of the present invention.

The present invention is intended for the woven fastener tape for a slide fastener including an element mount section and a tape main body section. The element mount section is a portion where elements are mounted, and the tape main body section is a portion that is sewn to a body of an article. A side edge of the tape main body section of the fastener tape may further have a selvage section provided with a selvage yarn for preventing yarns from getting loose. The element mount section may have a core string section along a longitudinal direction of the fastener tape, and the core string section is used when injection elements or metal elements are mounted.

In the fastener tape according to the present invention, the tape main body section has a mesh section. The framework of the mesh section is formed by sets of three or more warp yarns and sets of three or more weft yarns, and has a mesh structure with an opening formed among the sets of warp yarns and the sets of weft yarns. The framework formed by the warp yarns and the weft yarns plays a role of reinforcing the fastener tape, and the opening plays a role of increasing the air permeability. In the mesh section, the interlacing density of the outermost warp yarns and weft yarns is respectively higher than the interlacing density of the warp yarns and the weft yarns that are on the inner side of the outermost yarns in each set of warp yarns and weft yarns. In other words, the two warp yarns that are on the right and left sides out of the warp yarns in each set have higher interlacing density than the warp yarns that are on the inner side of those yarns, and similarly, the two weft yarns that are on the top and bottom sides out of the weft yarns in each set have higher interlacing density than the weft yarns that are on the inner side of those yarns.

The outermost warp yarns and weft yarns in each set of the warp yarns and the weft yarns correspond to the warp yarns and the weft yarns that define each of the openings, and when the interlacing density of those yarns is high, the shape of the opening can be maintained to prevent the mesh deviation. Moreover, when, in each set of the warp yarns and the weft yarns, the interlacing density of the inner warp yarns and weft yarns is lower than that of the outermost warp yarns and weft yarns, the force operates to pull the warp yarns and the weft yarns toward the inside of each set, suppressing the mesh deviation further. On the contrary, when the interlacing density of the inner warp yarns and weft yarns is higher than or equal to that of the outermost warp yarns and weft yarns, the warp yarns and the weft yarns are easily moved outward from each set, and in this case, the mesh deviation easily occurs.

Here, the interlacing density of the warp yarn is based on the number of times of interlacing with the weft yarns through the floating and sinking until the warp yarn traveling in the longitudinal direction of the fastener tape crosses the weft yarns for a certain number of times. Moreover, the interlacing density of the weft yarn is based on the number of times of interlacing with the warp yarns through the floating and sinking until the weft yarn traveling in the width direction of the fastener tape crosses the warp yarns for a certain number of times. As the number of interlacing times is larger, the interlacing density is higher. For example, the 1/1 (warp yarn/weft yarn) weave structure, in which the warp yarn crosses over one weft yarn and then crosses under one weft yarn, has smaller interlacing density than the 2/2 weave structure, in which the warp yarn crosses over two weft yarns and then crosses under two weft yarns.

In the present invention, each set of the warp yarns and the weft yarns forming the framework of the mesh structure is composed of three or more warp yarns and three or more weft yarns. This is for the purpose of securing the strength and forming the mesh structure that suppresses the mesh deviation with the weave structure (the mesh deviation refers to the deviation of the warp yarn and/or the weft yarn in the width direction or the longitudinal direction of the fastener tape). Note that when the number of the warp yarns and the weft yarns in each set is excessively large, the mesh deviation occurs more easily or the proportion of the opening area in the fastener tape becomes small to deteriorate the air permeability; thus, each set is preferably composed of three to five warp yarns and three to five weft yarns.

Therefore, in a preferred embodiment of the fastener tape of the present invention, the outermost warp yarns and weft yarns in each set of the warp yarns and the weft yarns are selected from the 1/1, 1/2, and 2/1 weave structures, and the warp yarns and the weft yarns that are on the inner side of the outermost yarns are selected from the 3/3 and 4/4 weave structures.

Here, the 1/1 weave structure of the warp yarn refers to the weave structure in which the warp yarn crosses over one weft yarn and crosses under one weft yarn, the 1/2 weave structure of the warp yarn refers to the weave structure in which the warp yarn crosses over one weft yarn and crosses under two weft yarns, the 2/1 weave structure of the warp yarn refers to the weave structure in which the warp yarn crosses over two weft yarns and crosses under one weft yarn, the 3/3 weave structure of the warp yarn refers to the weave structure in which the warp yarn crosses over three weft yarns and crosses under three weft yarns, and the 4/4 weave structure of the warp yarn refers to the weave structure in which the warp yarn crosses over four weft yarns and crosses under four weft yarns. Similarly, the 1/1 weave structure of the weft yarn refers to the weave structure in which the weft yarn crosses over one warp yarn and crosses under one warp yarn, the 1/2 weave structure of the weft yarn refers to the weave structure in which the weft yarn crosses over one warp yarn and crosses under two warp yarns, the 2/1 weave structure of the weft yarn refers to the weave structure in which the weft yarn crosses over two warp yarns and crosses under one warp yarn, the 3/3 weave structure of the weft yarn refers to the weave structure in which the weft yarn crosses over three warp yarns and crosses under three warp yarns, and the 4/4 weave structure of the weft yarn refers to the weave structure in which the weft yarn crosses over four warp yarns and crosses under four warp yarns.

In each set of the warp yarns and the weft yarns that form the framework of the mesh structure, the dimension of the weft yarn set in the longitudinal direction of the fastener tape is preferably larger than that of the warp yarn set in the width direction of the fastener tape. In other words, in each set of the warp yarns and the weft yarns that form the framework of the mesh structure, the total thickness of the weft yarns is preferably larger than the total thickness of the warp yarns. Further, the number of weft yarns is preferably larger than the number of warp yarns. In the fastener tape, the crosswise tensile strength is considered more important than the longitudinal tensile strength. In this point, the crosswise tensile strength can be increased by increasing the total thickness of the weft yarns as compared with the total thickness of the warp yarns or using more weft yarns than the warp yarns. In a preferred embodiment of the fastener tape of the present invention, each set of the warp yarns and the weft yarns that form the framework of the mesh structure is composed of three warp yarns with four weft yarns, four warp yarns with five weft yarns, or three warp yarns with five weft yarns.

The size of the opening of the mesh section can be adjusted by changing the intervals among the sets of the warp yarns and the weft yarns. When the opening area is increased, the air permeability is improved but the strength of the fastener tape tends to deteriorate. Thus, the opening area may be set as appropriate in consideration of the air permeability and the strength. As an example, the area of each opening may be 0.36 to 6 $mm^2$, and is preferably 1 to 4 $mm^2$.

The space among the frameworks of the mesh section composed of the warp yarns and the weft yarns serves as the opening; thus, the opening is basically rectangular or square in shape. In particular, the rectangular shape that is longer in the width direction of the fastener tape than in the longitudinal direction of the fastener tape is preferable even though the area is the same. This is because such a rectangular shape makes the density of the weft yarns relatively higher, so that the horizontal pulling strength of the fastener tape can be increased. For example, the opening can have an aspect ratio of 1:1.1 to 3.0, typically 1:1.2 to 2.0.

In one embodiment of the fastener tape according to the present invention, the tape main body section can be divided into a first section that is close to the element mount section, and a second section that is distant from the element mount section. The first section can be composed of the mesh section and the second section can be composed of a weave structure with higher weaving density than the mesh section. Thus, for example, the first section can be left unsewn to a body of a product for securing the air permeability, while the second section can be sewn to the body of the product with high sewing strength. Here, the weaving density refers to the weight per unit area of the fastener tape.

In a preferred embodiment of the fastener tape according to the present invention, the warp yarns of the first section are more twisted than the warp yarns of the second section. Since the first section is the mesh section, the opening thereof is preferably secured certainly in terms of air permeability. In this point, the coverage of the opening can be suppressed because the use of the more twisted warp yarns can suppress the deformation of the yarns to cause the collapse. The use of the twisted yarns can secure the strength of the opening and this contributes to the prevention of the mesh deviation. On the other hand, the use of less twisted yarns for the second section can suppress the excessive hardness of the fastener tape, whereby the soft texture can be obtained.

Similarly, in a preferred embodiment of the fastener tape according to the present invention, the weft yarns are more twisted than the warp yarns of the second section. In the structure of the woven fabric, the weft yarns generally run across the fastener tape in the width direction thereof; therefore, the same yarns are usually used as the weft yarns in the first section and the second section. Thus, the use of weft yarns that are more twisted than the warp yarns of the second section can secure the opening for the mesh structure in the first section and can suppress the excessive hardness of the fastener tape in the second section, whereby the soft texture can be obtained.

The aforementioned idea for the second section of the tape main body section similarly applies to the element mount section; the element mount section can be composed of the weave structure with higher weaving density than the mesh section. The use of warp yarns, which are less twisted than the yarns of the mesh section, for the element mount section can suppress the excessive hardness of the fastener tape, whereby the soft texture can be obtained.

For securing the opening in the mesh section, one of or both the warp yarns and the weft yarns of the mesh section preferably have a twisting coefficient of 2.0 T/M (twists/meter) or more per dtex, typically 2.0 to 3.0 T/M. From another perspective, the yarns are preferably twisted for 400 times or more, and more preferably 500 times or more, and typically about 400 to 600 times per meter. One yarn can be composed of a monofilament or a multifilament formed by binding two or more monofilaments, or further a plurality of multifilaments.

The warp yarns of the first section are preferably thinner than the warp yarns of the element mount section and the second section. Since the first section is the mesh section, the use of thin yarns is advantageous for increasing the opening. Meanwhile, the use of thick yarns for the element mount section and the second section is advantageous in that the tape can have a certain degree of thickness and the texture is favorable. In the element mount section, moreover, the thickness of the tape suppresses the leakage of molten material or the like when the fastener element is formed by injection molding. Specifically, the fineness of one warp yarn used in the mesh section is preferably, for example, 84 to 560 dtex, and more preferably 110 to 330 dtex. The fineness of one warp yarn used in the element mount section and the second section is preferably, for example, 160 to 660 dtex, and more preferably 330 to 560 dtex. The weft yarn is preferably as thick as the warp yarn in the mesh section.

The material for the yarns used in the fastener tape according to the present invention may be conventionally used polyester, nylon, polypropylene, acrylic, or the like, and is preferably polyester because polyester is easily sewn and has high material strength.

Here, FIG. 1 depicts a weaving structure of a fastener tape (100) according to a first embodiment of the present invention. This fastener tape (100) has an element mount section (101), a tape main body section (102), and a selvage section (103) arranged in this order. The element mount section (101) is provided with a core string section (104) for increasing the mount strength when the injection element or the metal element is mounted. The tape main body section (102) is composed of a first section (105) with a mesh structure, which is close to the element mount section (101), and a second section (106) with a high weaving density, which is distant from the element mount section (101).

The first section (105) is formed using warp yarns and weft yarns with 210 dtex and a twisting coefficient of 2.48 T/M. Therefore, the yarns that are twisted by approximately 520 times per meter are used. In the first section (105), the framework of the mesh structure of the first section is composed of sets of warp yarns and weft yarns, each set consisting of three warp yarns and three weft yarns. In the present invention, two yarns constitute one weft yarn and in FIG. 1 and six weft yarns constituting a set are counted as three yarns. Of the three warp yarns constituting a set of warp yarns, two warp yarns on the right and left sides (the outermost warp yarns in each set) are the 1/1 weave structure, and the central warp yarn (inner warp yarn in each set) is the 3/3 weave structure. Of the three weft yarns constituting a set of weft yarns, two weft yarns on the top and bottom sides (the outermost weft yarns in each set) is the 1/1 weave structure, and the central weft yarn (inner weft yarn in each set) is the 3/3 weave structure. An opening 107 is formed among two adjacent sets of warp yarns (set A and set B) and two adjacent weft yarns (set C and set D). Here, the warp yarns and the weft yarns adjacent to the opening 107 are the outermost warp yarns in the set A and the set B, and the outermost weft yarns in the set C and the set D. In each set of the warp yarns, the interlacing state between the outermost warp yarn and the outermost weft yarn is in the opposite relation to the interlacing state between the inner warp yarn and the outermost weft yarn. For example, in the case where the inner warp yarn goes on the front side of the outermost weft yarn in each set of the warp yarns, the outermost warp yarn goes on the back side of the outermost weft yarn. This similarly applies to the weft yarns. In other words, in each set of the weft yarns, the interlacing state between the outermost weft yarn and the outermost warp yarn is in the opposite relation to the interlacing state between the inner weft yarn and the outermost warp yarn. This similarly applies to the embodiments described below though the number of yarns and the weave structure may be different. When the warp yarns and the weft yarns have such a structure, the effect of preventing the mesh deviation can be increased. Each opening (107) of the first section is a rectangle with a horizontal length of 2 mm and a vertical length of 1.2 mm.

In the element mount section (101) and the second section (106), the warp yarns and the weft yarns are the combination of the 1/1 and 2/2 weave structures, which plays a role of fixing the position of the mesh section. Other weave structures are also applicable. Note that the number of the core strings is not limited to one but may be two. The element mount section (101) and the second section (106) employ the warp yarns with 300 dtex, which have been false twisted. The false twisted yarn is the yarn that has been twisted in one direction and then in the opposite direction, so that the yarn is hardly twisted. Therefore, the number of twists per meter is smaller than that of the warp yarn of the first section (105) and the weft yarn.

Figure 2:
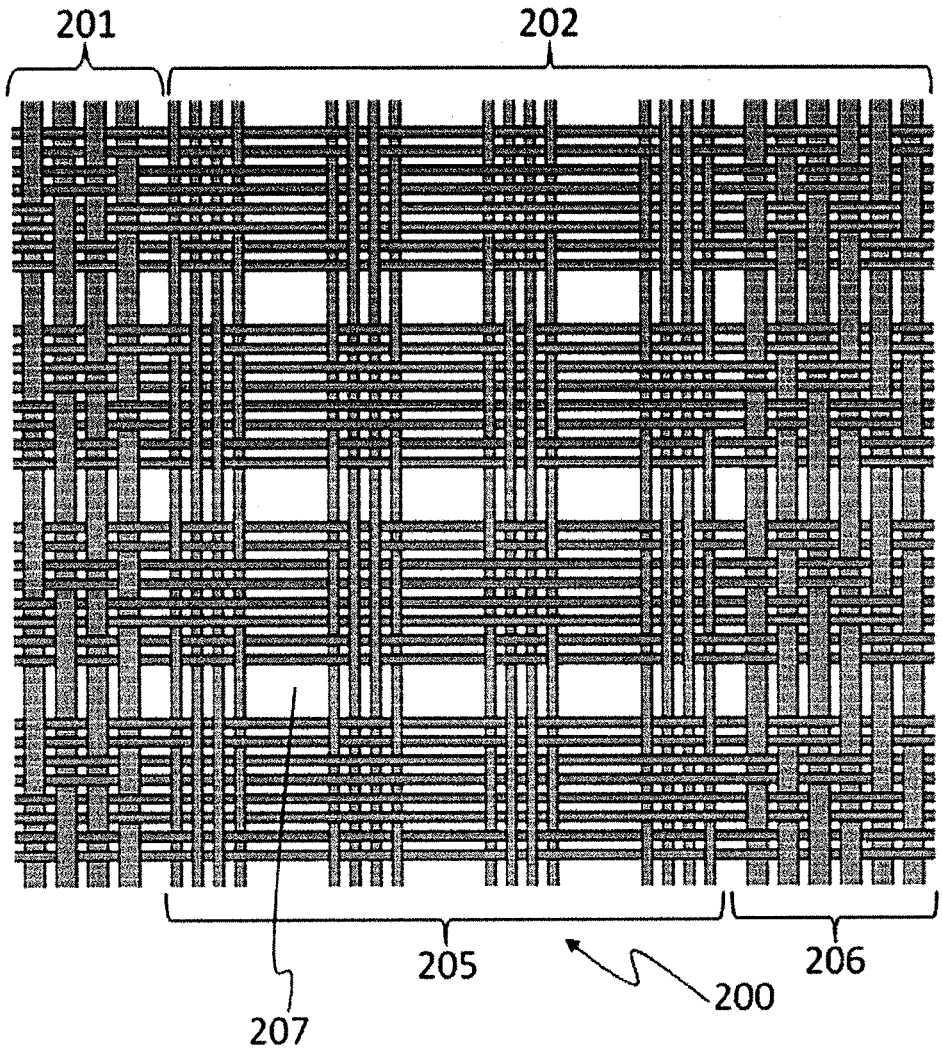
FIG. 2 depicts a weave structure of a fastener tape according to a second embodiment of the present invention.

FIG. 2 partially depicts an element mount section (201) and a tape main body section (202) of a fastener tape (200) according to a second embodiment of the present invention. The tape main body section (202) is composed of a first section (205) with a mesh structure, which is close to the element mount section (201), and a second section (206) with higher weaving density, which is distant from the element mount section (201).

In the first section (205), the warp yarns and the weft yarns are 210 dtex and have a twisting coefficient of 2.48 T/M; therefore, they are the yarns twisted by approximately 520 times per meter. In the first section (205), the framework of the mesh structure of the first section is formed by four warp yarns and four weft yarns as a set. As described above, in the present invention, two weft yarns are paralleled and counted as one yarn; thus, eight weft yarns constituting a set of weft yarns in FIG. 2 are counted as four yarns. Of the four warp yarns constituting a set of warp yarns, two warp yarns on the right and left sides are the combination of the 1/2 and 2/1 weave structures, and the central two warp yarns are the 4/4 weave structure. Of the four weft yarns constituting a set of weft yarns, two weft yarns on the top and bottom sides are the combination of the 1/2 and 2/1 weave structures, and the central two weft yarns are the 4/4 weave structure. An opening (207) of the first section is a rectangle with a horizontal length of 1.8 mm and a vertical length of 1 mm.

In the element mount section (201) and the second section (206), the warp yarns and the weft yarns are the combination of the 1/1 and 2/2 weave structures, which plays a role of fixing the position of the mesh section. The element mount section (201) and the second section (206) employ the yarns with 330 dtex, which have been false twisted.

Figure 3:
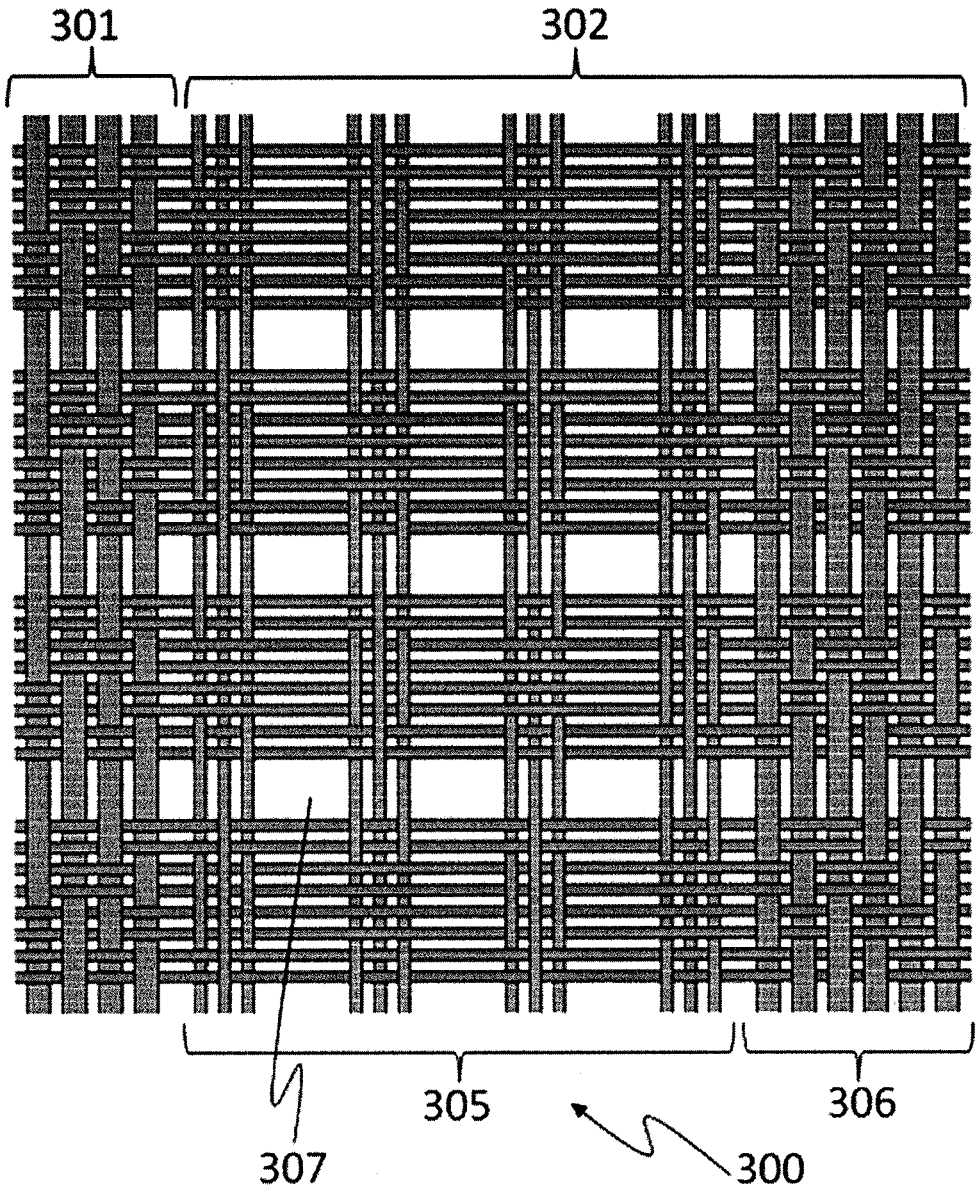
FIG. 3 depicts a weave structure of a fastener tape according to a third embodiment of the present invention.

FIG. 3 partially depicts an element mount section (301) and a tape main body section (302) of a fastener tape (300) according to a third embodiment of the present invention. The tape main body section (302) is composed of a first section (305) with a mesh structure, which is close to the element mount section (301), and a second section (306) with higher weaving density, which is distant from the element mount section (301).

In the first section (305), the warp yarns and the weft yarns are 210 dtex and have a twisting coefficient of 2.0 T/M; therefore, they are the yarns twisted by approximately 420 times per meter. In the first section (305), the framework of the mesh structure of the first section is formed by three warp yarns and four weft yarns as a set. As described above, in the present invention, two weft yarns are counted as one yarn; thus, eight weft yarns constituting a set of weft yarns in FIG. 3 are counted as four yarns. Of the three warp yarns constituting a set of warp yarns, two warp yarns on the right and left sides are the combination of the 1/2 and 2/1 weave structures, and the central warp yarn is the 4/4 weave structure. Of the four weft yarns constituting a set of weft yarns, two weft yarns on the top and bottom sides are the combination of the 1/2 and 2/1 weave structures, and the central two weft yarns are the 3/3 weave structure. An opening (307) of the first section is a rectangle with a horizontal length of 2 mm and a vertical length of 1 mm.

In the element mount section (301) and the second section (306), the warp yarns and the weft yarns are the combination of the 1/1 and 2/2 weave structures, which plays a role of fixing the position of the mesh section. The element mount section (301) and the second section (306) employ the warp yarns with 330 dtex, which have been false twisted.

Figure 4:
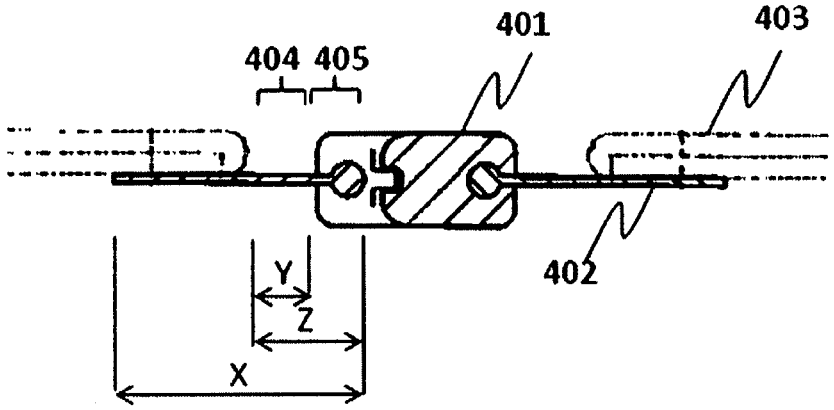
FIG. 4 is a schematic diagram depicting a cross section of a pair of fastener tapes having the elements mounted thereto.

Here, FIG. 4 is a schematic cross-sectional view of a pair of fastener tapes (402) having elements (401) mounted thereto. A dotted line represents a cloth (403) of a body of a product to which the fastener tape is sewn. A symbol X represents the total width of the fastener tape, a symbol Y represents the width of the mesh section, and a symbol Z represents the width from the end of the fastener tape on the tape mount section side to the end of the mesh section.

When the width Y of the mesh section (404) becomes too large, the fastener tape becomes too soft, in which case the cloth has low stiffness. Meanwhile, when the width Y becomes too small, the air permeability becomes impaired. In view of this, the width Y of the mesh section is preferably set to 10 to 50% of the width X of the entire fastener tape. When the width Z from the end of the fastener tape on the tape mount section side to the end of the mesh section becomes too large, the tape allows a smaller margin to sew up; meanwhile, when the width Z becomes too small, the air permeability is deteriorated. Therefore, the width Z is preferably 30 to 60% of the width X.

<2. Slide Fastener>

The mount of the elements to the element mount section of the fastener tape makes a fastener stringer, and the engagement of the right and left stringers completes a fastener chain. Then, the mount of a slider and, if necessary, a stopper to the slide fastener chain completes the slide fastener.

In the present invention, there is no restriction to the type of the elements. For example, a single piece element as represented by a metal element and a plastic element molded on a tape by injection, a continuous element as represented by a coiled plastic element may be mentioned.

The kind of the slide fastener is not particularly limited, and the present invention is applicable to any type of slide fasteners such as a non-separable product with a bottom end stop, a separable product having a separable bottom end stop, a reversely openable type, a head-to-head type, a back-to-back type, or a loop type.

Figure 5:
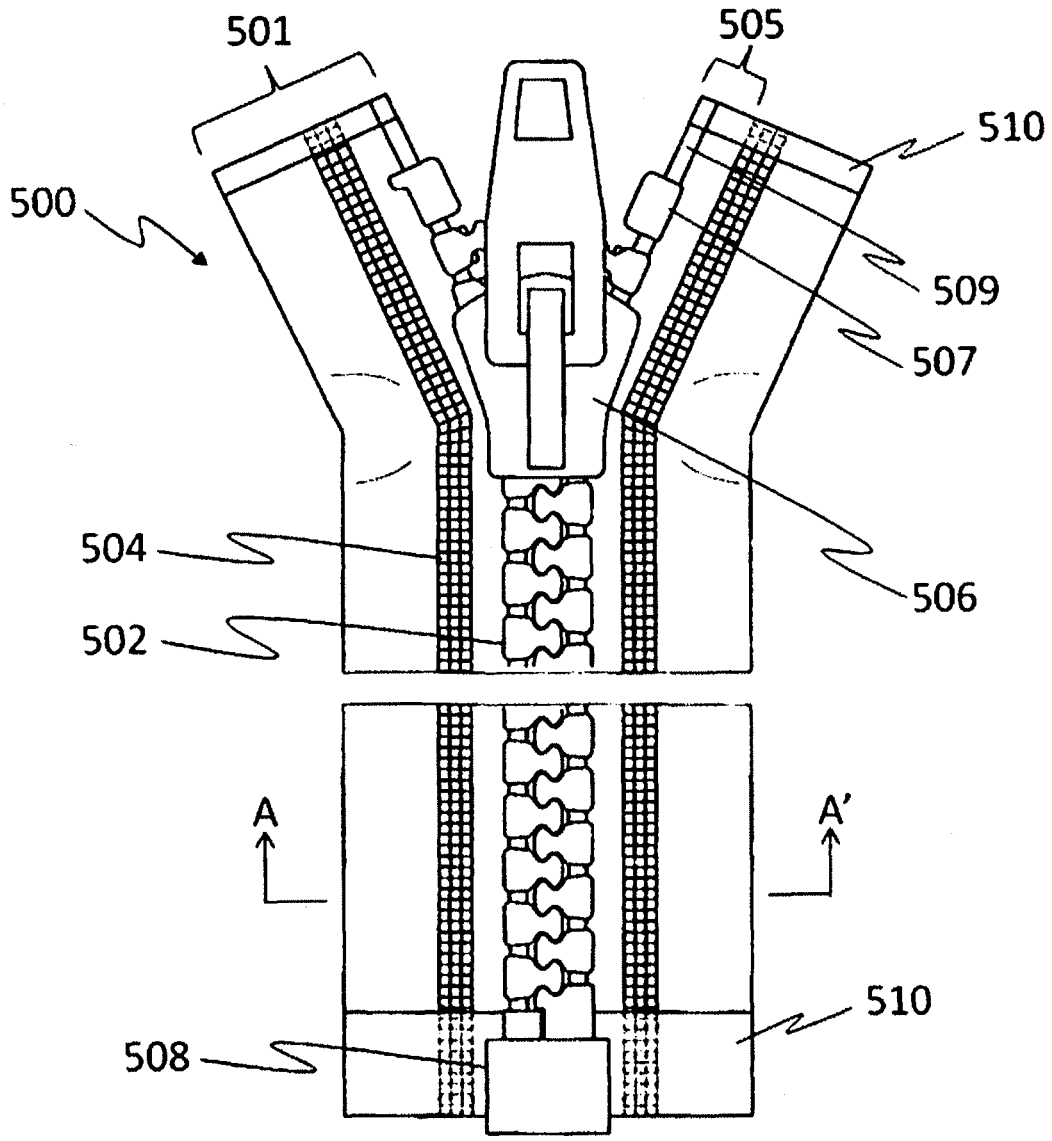
FIG. 5 depicts an example of a slide fastener having a fastener tape according to the present invention.

FIG. 5 depicts an example of the slide fastener having the fastener tape according to the present invention. Ina slide fastener (500) of FIG. 5, resin elements (502) are mounted to a fastener tape (501) according to the present invention having a mesh section (504) along a core string (509) of an element mount section (505) through injection molding. A slider (506) is inserted into a row of the elements (502). A top end stop (507) is provided at an upper end of the row of the resin elements (502) and a separable bottom end stop (508) is provided at a lower end thereof. In this embodiment, the width of the mesh section is approximately 20% of the width of the fastener tape. In this embodiment, the width from the end of the fastener tape on the tape mount section side to the end of the mesh section is approximately 53% of the width of the fastener tape. The slider (506) slides on the element mount section (505) and the mesh section (504) is preferably positioned outside the portion where the slider (506) slides.

At one of or both the upper end and the lower end of the fastener tape, a reinforcement film is preferably pasted transversely across the mesh section such that the reinforcement film pinches a front side and a back side of the fastener tape. This provides the effect that the reinforcement film easily gets in close contact with the fastener tape, and moreover since the mesh section is not exposed at the upper end or the lower end, the strength at the end is improved. In this embodiment, a reinforcement film (510) is pasted at the upper end and the lower end.

Figure 6:
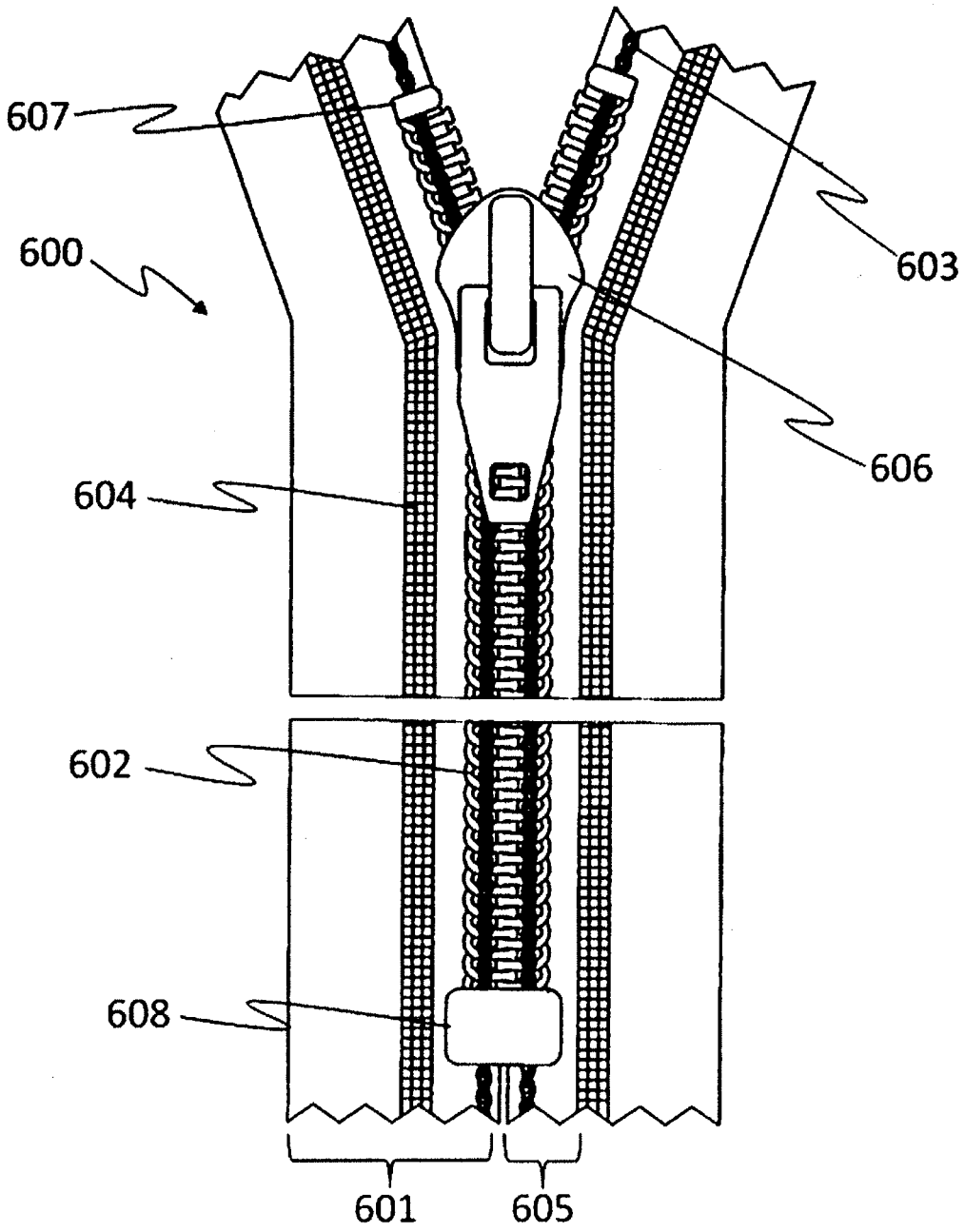
FIG. 6 depicts another example of the slide fastener having the fastener tape according to the present invention.
Figure 7:
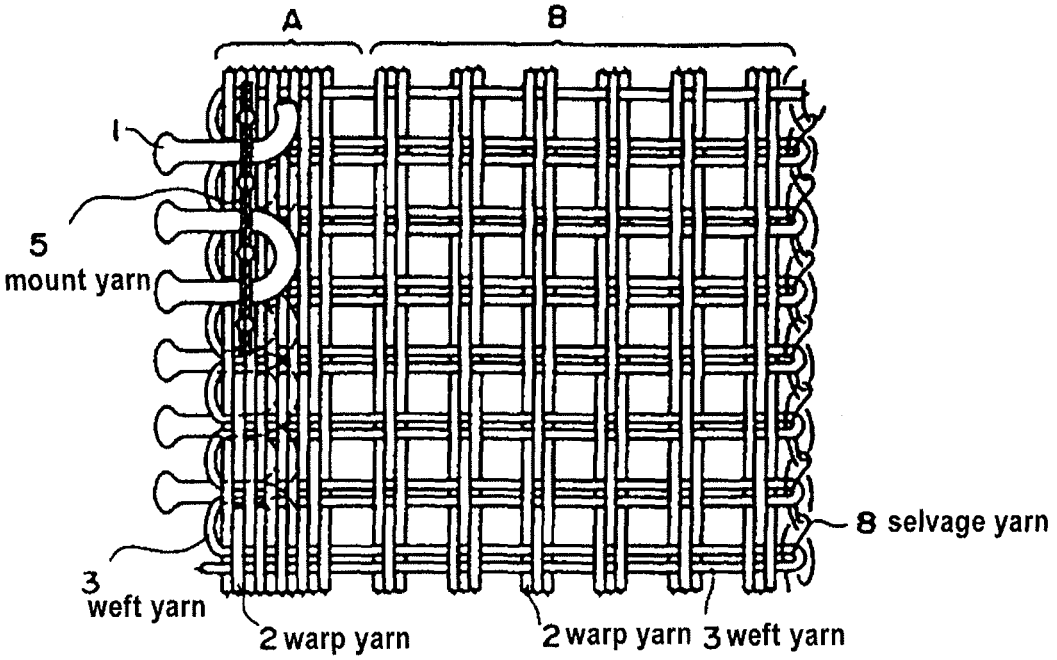
FIG. 7 depicts a structure of a woven tape for a slide fastener disclosed in FIG. 1 of Japanese Examined Utility Model Application Publication No. H5-42731 (Patent Literature 1).

FIG. 6 depicts another example of the slide fastener having the fastener tape according to the present invention. In a fastener tape (601) according to the present invention having a mesh section (604) of a slide fastener (600) of FIG. 6, coil-like elements (602) are sewn to an element mount section (605) with a sewing yarn (603), and a slider (606) is inserted into a row of the elements (602). A top end stop (607) is provided at an upper end of the row of the coil-like elements (602) and a bottom end stop (608) is provided at a lower end thereof. In this embodiment, the width of the mesh section is approximately 15% of the width of the fastener tape. In this embodiment, the width from the end of the fastener tape on the tape mount section to the end of the mesh section is approximately 52% of the width of the fastener tape. The slider (606) slides on the element mount section (605) and the mesh section (604) is preferably positioned outside the portion where the slider (606) slides.

The slide fastener of the present invention can be used as an opener/closer of an article by being sewn to the article. For example, the slide fastener can be applied to an opening of clothes, a pocket, a bag, shoes (for example, boots or other shoes), a tent, a mattress of a bed, or seats of a vehicle, for which the air permeability is required. For opening/closing the article, the slider is used for engaging or releasing the fastener elements. When the article does not need to be opened, the slider may be removed after closing the slide fastener.

The embodiments of the present invention have been described so far; however, the present invention is not limited to those embodiments above and various modifications can be made within the scope of the present invention.

REFERENCE SIGNS LIST

100 fastener tape
101 element mount section
102 tape main body section
103 selvage section
104 core string section
105 first section of tape main body section
106 second section of tape main body section
107 opening
200 fastener tape
201 element mount section

202 tape main body section
205 first section of tape main body section
206 second section of tape main body section
207 opening
300 fastener tape
301 element mount section
302 tape main body section
305 first section of tape main body section
306 second section of tape main body section
307 opening
401 element
402 fastener tape
403 cloth
404 mesh section
500 slide fastener
501 fastener tape
502 resin element
504 mesh section
505 element mount section
506 slider
507 top end stop
508 separable bottom end stop
509 core string
510 reinforcement film
600 slide fastener
601 fastener tape
602 coil-like element
603 sewing yarn
604 mesh section
605 element mount section
606 slider
607 top end stop
608 bottom end stop

The invention claimed is:

1. A woven fastener tape for a slide fastener, comprising:
an element mount section; and
a tape main body section, wherein:
the tape main body section includes a plurality of crossing sections in which a bundle of three or more warp yarns cross a bundle of three or more pairs of weft yarns;
the tape main body section has a first section with a mesh structure having a plurality of openings between adjacent bundles of the warp yarns and adjacent bundles of the weft yarns; and
in the first section, an interlacing density of outermost warp yarns of each crossing section and an interlacing density of outermost pairs of weft yarns of each bundle of each crossing section are respectively higher than an interlacing density of inner warp yarns located between the outermost warp yarns and an interlacing density of an inner pair of weft yarns located between the outermost pairs of weft yarns, wherein each outermost pair of weft yarns includes two adjacent weft yarns and the inner pair of weft yarns includes two adjacent weft yarns,
wherein the interlacing density of the outermost warp yarns and the inner warp yarns is based on a number of times the outermost warp yarns and the inner warp yarns interlace with the weft yarns in the crossing section as the outermost warp yarns and the inner warp yarns extend in a longitudinal direction of the fastener tape, and
wherein the interlacing density of the outermost pairs of weft yarns and the inner pair of weft yarns is based on a number of times the outermost pairs of weft yarns and the inner pair of weft yarns interlace with the warp yarns in the crossing section as the outermost pairs of weft yarns and the inner pair of weft yarns extend in a width direction of the fastener tape.

2. The fastener tape for a slide fastener according to claim 1, wherein each opening of the first section has an area of 0.36 to 6 $mm^2$.

3. The fastener tape for a slide fastener according to claim 1, wherein in each crossing section of the first section, a dimension of the bundle of warp yarns in the width direction of the fastener tape is smaller than a dimension of the bundle of weft yarns in the longitudinal direction of the fastener tape.

4. The fastener tape for a slide fastener according to claim 1, wherein each bundle of the warp yarns of the mesh structure is composed of three to five warp yarns and each bundle of the weft yarns of the mesh structure is composed of three to five pairs of weft yarns.

5. The fastener tape for a slide fastener according to claim 1, wherein each crossing section of the first section includes more weft yarns than the warp yarns.

6. The fastener tape for a slide fastener according to claim 1, wherein, in the first section, the interlacing density of the outermost warp yarns and the interlacing density of the outermost pairs of weft yarns are selected from 1/1, 1/2, and 2/1 weave structures, and the interlacing density of the inner warp yarns and the interlacing density of the the inner pair of weft yarns are selected from 3/3 and 4/4 weave structures.

7. The fastener tape for a slide fastener according to claim 1, wherein:
the first section is close to the element mount section, and
the tape main body includes a second section that is distant from the element mount section; and
the second section has a weave structure with higher weaving density than the first section.

8. The fastener tape for a slide fastener according to claim 7, wherein the warp yarns of the first section are more twisted than warp yarns of the second section.

9. The fastener tape for a slide fastener according to claim 7, wherein the weft yarns of the first section are more twisted than warp yarns of the second section.

10. The fastener tape for a slide fastener according to claim 1, wherein any one of, or both the warp yarns and the weft yarns of the mesh section have a twisting coefficient of 2.0 Twists/Meter or more per decitex.

11. The fastener tape for a slide fastener according to claim 1, wherein each opening of the first section has a rectangular shape that is longer in the width direction of the fastener tape than in the longitudinal direction of the fastener tape.

12. The fastener tape for a slide fastener according to claim 1, wherein:
in each crossing section of the first section, the outermost warp yarns cross over one side of one of the outermost pairs of weft yarns while at least one inner warp yarn crosses over an opposite side of the one of the outermost pairs of weft yarns; and
in each crossing section of the first section, the outermost pairs of weft yarns cross over one side of one of the outermost warp yarns while at least one inner pair of weft yarns crosses over an opposite side of the one of the outermost warp yarns.

13. The fastener tape for a slide fastener according to claim 1, wherein at any one of, or both an upper end and a lower end of the fastener tape, a reinforcement film covers the first section in the width direction such that the reinforcement film pinches a front side and a back side of the fastener tape.

14. A slide fastener comprising the fastener tape for a slide fastener according to claim 1.

* * * * *